United States Patent [19]

Silfversparre

[11] Patent Number: 4,480,567

[45] Date of Patent: Nov. 6, 1984

[54] PIVOTABLE RIGID LINE FOR LINKING SAILOR TO BOOM OF SURFBOARD SAILBOAT

[76] Inventor: Bengt R. Silfversparre, Pontonjargatan 20, S-112 37 Stockholm, Sweden

[21] Appl. No.: 280,011

[22] PCT Filed: Nov. 18, 1980

[86] PCT No.: PCT/SE80/00293

§ 371 Date: Jul. 1, 1981

§ 102(e) Date: Jul. 1, 1981

[87] PCT Pub. No.: WO81/01541

PCT Pub. Date: Jun. 11, 1981

[30] Foreign Application Priority Data

Dec. 4, 1979 [SE] Sweden ..... 7909971

[51] Int. Cl.[3] ..... B63B 35/00

[52] U.S. Cl. ..... 114/39; 182/3

[58] Field of Search ..... 114/39, 103, 270; 441/110; 182/3, 4, 9

[56] References Cited

U.S. PATENT DOCUMENTS 4,047,255 9/1977 Kiefer ..... 441/110
4,112,865 9/1978 Carn ..... 114/39
4,140,205 2/1979 Matson ..... 182/3

FOREIGN PATENT DOCUMENTS 2306717 10/1976 France ..... 114/39

*Primary Examiner*—Trygve M. Blix
*Assistant Examiner*—Jesûs D. Sotelo
*Attorney, Agent, or Firm*—Sughrue, Mion, Zinn, Macpeak and Seas

[57] ABSTRACT

By replacing the line which links the sailor with the boom, when surf sailing subject to wind pressure and using a so-called harness, by a linking device (4) which is self-supporting and secured to boom (1) in such a manner as to be capable of being swung up and down, the sailor can, without letting go of boom (1), control the linking device (4) with his hands (2) and secure it to or remove it from the harness hook 3 located on the sailor's chest.

6 Claims, 1 Drawing Figure

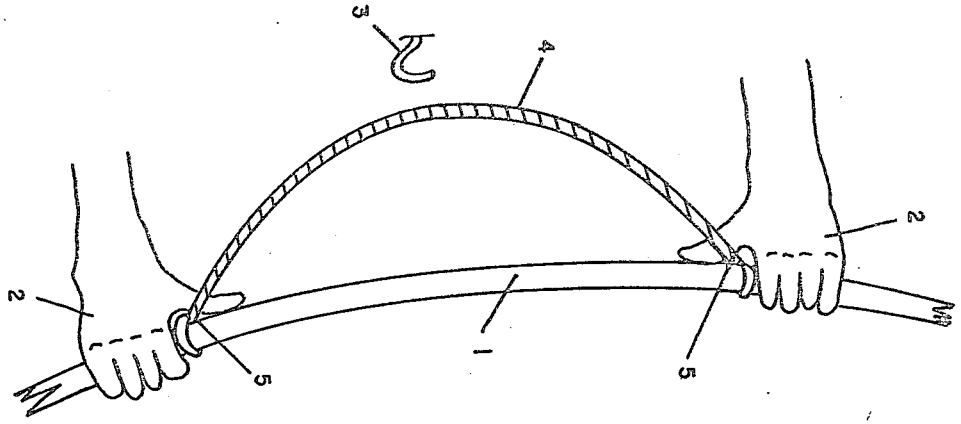
2
5
4
1
3
5
2

PIVOTABLE RIGID LINE FOR LINKING SAILOR TO BOOM OF SURFBOARD SAILBOAT

The invention relates to an arrangement for linking the sailor with the sail boom when surf sailing subject to wind pressure.

In the course of surf sailing subject to wind pressure the sailor is in certain cases provided with a so-called harness bearing a hook at the level of the sailor's chest. To this hook the sailor can connect one of the two lines, one on either side of the sail, which are secured to the sail boom. For surf sailing subject to wind pressure to be possible at all, the sailor engaged in this activity holds fast to the boom throughout, steering the craft inter alia by shifting the weight of his body. This can be difficult and can cause great fatigue during prolonged sailing. By making use of the said lines the sailor's arm muscles can be relieved. Owing to the sailing method, for instance when cruising, the lines must frequently be fixed to and removed from the hook.

In order to be able to secure or release the hook the sailor must in general let go of the boom with one hand. Holding the boom and the sail with only one hand reduces the steering ability and increases the danger of capsizing.

By the present invention as described in the characterising sections of the patent claims these disadvantages are entirely eliminated since the sailor is not compelled to let go of the boom with one hand, but can retain his two-handed grip on the boom throughout while releasing himself from or linking himself with the boom.

One embodiment of the invention is described below in detail with reference to the drawing, a schematic illustration of this embodiment of the invention.

1 designates a section of the boom which the sailor is gripping with both hands 2. The sailor wears a harness provided with a hook 3 at chest level. Directly within the normal gripping positions of the sailor's hands are fixed the free ends of a yoke 4. This yoke is substantially rigid, "self-supporting", along its entire curvature up to points close to its respective attachments to boom 1, the yoke being articulated at these attachment points in such a way that it can be swung upward and downward.

Without releasing his grip on boom 1 with his hands 2, the sailor can control the yoke 4 with his hands as indicated in the FIGURE, hooking on the yoke or releasing it from hook 3, thanks to the yoke's inherent rigidity.

Since the yoke shall normally be capable of being removed from and shifted along boom 1, the yoke may advantageously consist of a line part of which is covered with a plastic tube. The free ends of the line are placed around the boom 1 and attached to themselves in a suitable manner. Beyond the ends of the tube, where the line is attached to the boom, the line itself constitutes joints 5 contributing to the operation of the invention. The yoke can also consist of a line, coated or impregnated with a suitable stiffening agent along the stretch between the intended attachment points.

The linking device between the sailor and the boom can also consist of homogeneous material which is stiff but capable of being bent. In this case the device can be attached direct to the boom without joints or articulated sections. The capacity of swinging it up and down is due to the fact that the material as such is flexible.

The invention also extends to linking devices made of metal and provided with hinged joints attached to the boom with the aid of sleeves or screws.

I claim:

1. An arrangement for linking chest hook means (3) secured to the body of a sailor to a boom of a surfboard type sailboat, comprising: a substantially rigid and self-supporting, single elongate line member (4), and means (5) individually securing opposite ends of said line member to said boom (1) at two spaced attachment points for pivotal movement about said boom, whereby a sailor may grasp the boom with his forefingers adjacent the attachment points and pivotally raise the line member from a generally vertical dangling position with his thumbs, without releasing the boom, to thereby engage the line member with the hook means.

2. An arrangement in accordance with claim 1, wherein the line member is a longitudinally extending yoke.

3. An arrangement according to claims 1 or 2, wherein the securing means comprises articulated end sections of the line member.

4. An arrangement in accordance with claim 3, wherein the free ends of the line member are wrapped around the boom and secured to themselves.

5. An arrangement in accordance with claim 1, wherein the line member comprises a line and a plastic tube drawn thereover and extending close to the attachment points.

6. An arrangement in accordance with claim 1, wherein the line member comprises a line coated or impregnated with a stiffening agent.

* * * * *